US006128977A

United States Patent [19]

Gierer et al.

[11] Patent Number: 6,128,977

[45] Date of Patent: Oct. 10, 2000

[54] SHOCK-ABSORBING CLAW HAMMER

[75] Inventors: Joseph T. Gierer, Glen Carbon, Ill.; David L. Pringle, Town and Country, Mo.

[73] Assignee: Emerson Electric Co., St. Louis, Mo.

[21] Appl. No.: 09/005,198

[22] Filed: Jan. 9, 1998

Related U.S. Application Data

[60] Provisional application No. 60/042,057, Apr. 9, 1997.

[51] Int. Cl.[7] ..... B25D 1/00

[52] U.S. Cl. ..... 81/22; 81/20; 7/144

[58] Field of Search ..... 81/20, 22; 7/144

[56] References Cited

U.S. PATENT DOCUMENTS

| | | | |
|---|---|---|---|
| D. 285,284 | 8/1986 | Blomqvist . | |
| 776,191 | 11/1904 | Lynch | 7/144 |
| 1,045,145 | 11/1912 | Hubbard . | |
| 1,089,234 | 3/1914 | Leslie | 81/20 |
| 1,501,095 | 7/1924 | Brock . | |
| 2,604,914 | 7/1952 | Kahlen . | |
| 2,737,216 | 3/1956 | Kenerson . | |
| 2,928,444 | 3/1960 | Ivins . | |
| 2,940,492 | 6/1960 | Curry et al. . | |
| 3,000,414 | 9/1961 | Cordis | 81/22 |
| 3,030,989 | 4/1962 | Elliott | 81/22 |
| 3,704,734 | 12/1972 | Soto et al. . | |
| 4,039,012 | 8/1977 | Cook . | |
| 4,216,808 | 8/1980 | Royce . | |
| 4,331,193 | 5/1982 | Tudisco . | |
| 4,373,565 | 2/1983 | Soto . | |
| 4,498,464 | 2/1985 | Morgan . | |
| 4,697,481 | 10/1987 | Maeda . | |
| 4,738,166 | 4/1988 | Yamaguchi . | |
| 4,831,901 | 5/1989 | Kinne . | |
| 5,012,702 | 5/1991 | Taylor . | |
| 5,118,117 | 6/1992 | Denen . | |
| 5,216,939 | 6/1993 | Swenson . | |
| 5,249,776 | 10/1993 | Johnson . | |
| 5,289,742 | 3/1994 | Vaughan . | |
| 5,375,487 | 12/1994 | Zimmerman . | |
| 5,408,902 | 4/1995 | Burnett | 81/22 |
| 5,537,896 | 7/1996 | Halder . | |

FOREIGN PATENT DOCUMENTS

| | | |
|---|---|---|
| 1137125 | 5/1957 | France . |
| 1 273 449 | 7/1968 | Germany . |
| 4206588-A1 | 1/1993 | Germany . |

*Primary Examiner*—Timothy V. Eley
*Assistant Examiner*—Willie Derry, Jr.
*Attorney, Agent, or Firm*—Howrey Simon Arnold & White, LLP

[57] ABSTRACT

A shock-absorbing claw hammer includes a handle, a claw and a striking head. Vibrations in the handle caused by the striking head striking an object are at least partially reduced by shock-absorbing means. In one embodiment, the head includes a top surface and a lower surface, with the lower surface of the head coupled to the handle. The claw includes a first slit for pulling nails, and the head further defines a second slit extending from the top surface of the head towards the lower surface of the head situated generally between the striking head and the claw. In another embodiment, tension and compression rebars are positioned within the handle, with the striking head coupled to the compression rebar and the claw coupled to the tension rebar such that the striking head and the claw move relative to one another upon striking an object. In a further embodiment, the handle includes a first end opposite a second end with a main striking head and a secondary striking head coupled to the first end and the claw coupled to the second end. In yet other embodiments, the striking head and the claw are configured to move with respect to each other when the striking head strikes an object.

24 Claims, 5 Drawing Sheets

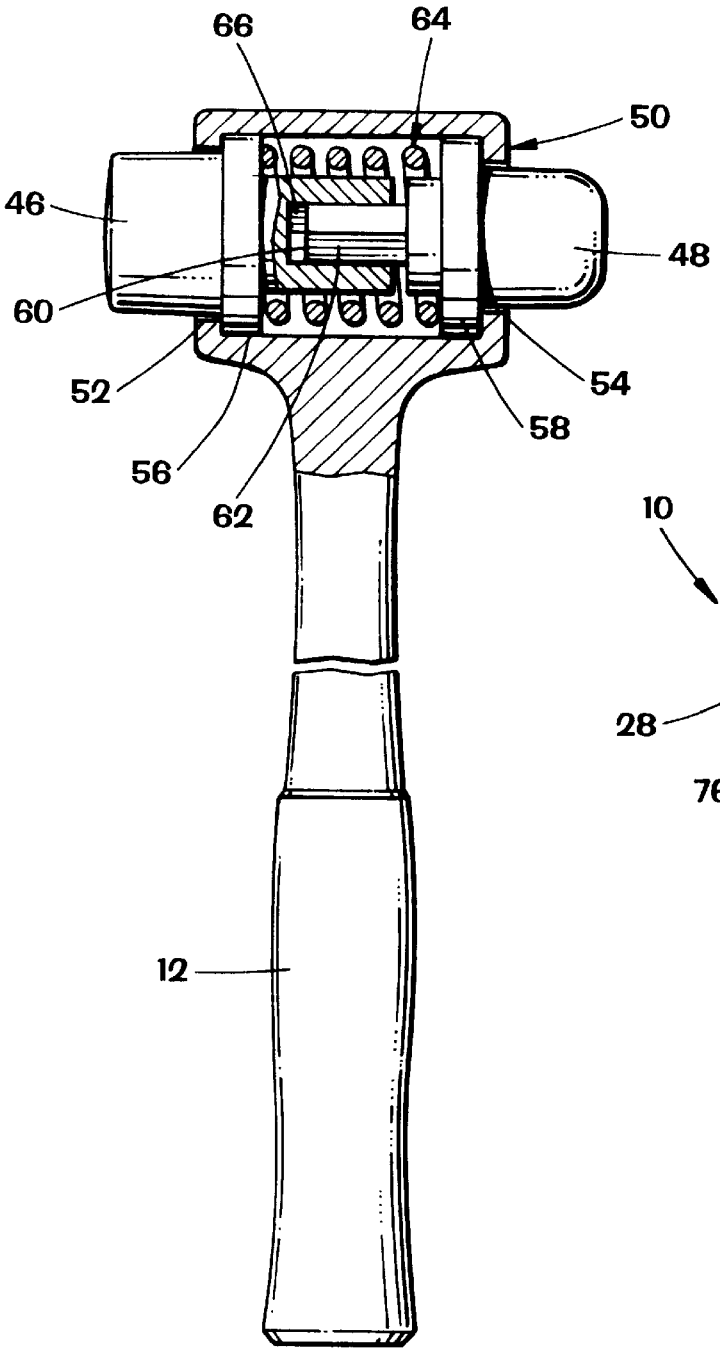
FIG.4
FIG.7
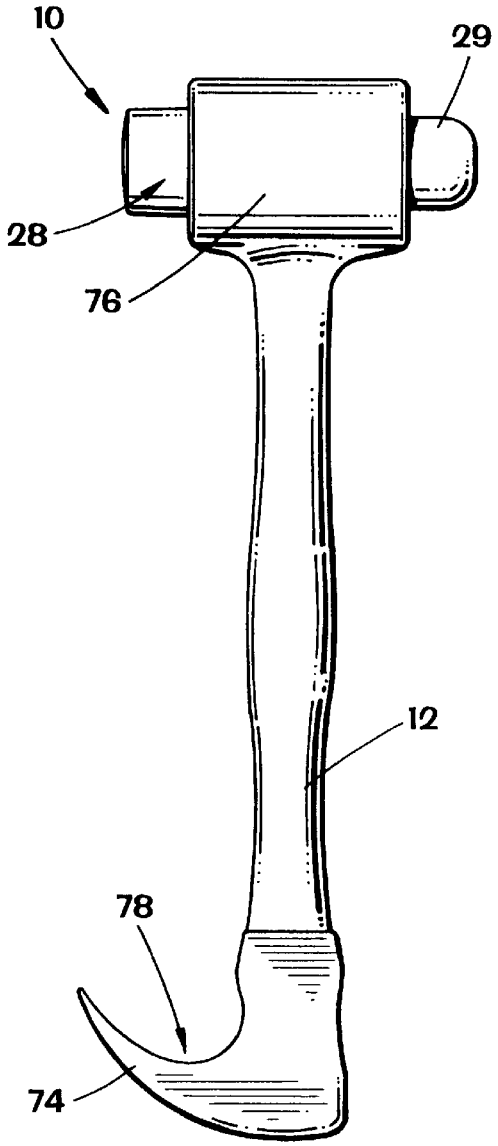

SHOCK-ABSORBING CLAW HAMMER

CROSS-REFERENCE TO RELATED APPLICATION

This application claims the benefit of U.S. Provisional Application Ser. No. 60/042,057, entitled "Dead Blow Hammer with Claw Feature," filed Apr. 9, 1997 by the same inventors, which is incorporated herein by reference in its entirety.

BACKGROUND OF THE INVENTION

1. Field of the Invention

This invention relates to hammers for driving nails and striking various objects and, in particular, shock-absorbing or dead blow hammers that reduce the recoil and vibration caused by the hammer strike. More particularly, the present invention relates to a non-rebounding, shock-absorbing hammer including a claw feature.

2. Description of Related Art

When a percussive tool, such as a hammer, strikes the surface of an object, part of the energy produced by the strike is used to perform desired work (e.g., drive a nail), part is converted into heat, and part is dissipated through the hammer. The energy that is dissipated through the hammer often produces undesirable results such as recoil of the hammer from the struck surface or excessive vibration of the hammer. The undesirable results produced by hammer strikes have been a persistent problem for the makers of hammers and other percussive tools.

In the past, various attempts have been made to reduce undesirable results produced by a hammer strike. Hammers that have minimal rebound or recoil characteristics are sometimes referred to as "dead blow" hammers, shock-absorbing hammers or vibration-reducing hammers. The terms dead blow, shock-absorbing and vibration-reducing are used interchangeably herein. One of the earliest attempts reflected in the prior art to produce a dead-blow or shock-absorbing hammer is U.S. Pat. No. 1,045,145, issued in November 1912 to E. O. Hubbard ("Hubbard"). As explained by Hubbard, when the Hubbard hammer is struck against a surface, the striking head will be forced against a cushion, such that the cushion absorbs a portion of the shock of impact produced by the strike.

Following Hubbard, several other attempts were made to reduce the undesirable results of a hammer strike and, in particular, to reduce the recoil or rebound produced when a hammer strike occurs. Several early approaches for reducing recoil in hammers are summarized in U.S. Pat. No. 2,604,914 to Kahlen ("Kahlen") issued in July 1952. In particular, Kahlen indicates that, by 1952, known methods for reducing hammer recoil included placing either a slug, a charge of round shot, or a charge of powdered material in a chamber immediately behind a striking face of the hammer, such that the object(s) placed behind the striking head will absorb some of the forces produced by the hammer strike. The particular approach disclosed in Kahlen involved the placement of a charge of irregularly-shaped, hard heavy particles in a chamber immediately behind the striking head of a hammer.

In addition to solutions involving cushions and charge loads, several solutions utilizing resilient members, such as elastic inserts and springs, were proposed to address the hammer strike problems, whereby a portion of the energy developed from the hammer strike is dissipated through the resilient member. Other designs, such as that disclosed in U.S. Pat. No. 5,408,902, use a "lagging mass," which is positioned to move towards the striking portion of the hammer head when it impacts, thus impacting the striking portion to reduce hammer recoil.

These early approaches suffer from one or more difficulties. For example, the use of slidable weights or slugs behind the striking head of the hammer is problematic because the weights themselves develop potential energy when the hammer strikes a surface and tend to recoil, thus, causing undesirable vibration or oscillation of the hammer. Further, shot-filled hammers are limited: (i) because the requirement for a hollow chamber renders the size of such hammers out of proportion to their weight; and (ii) because, unless a special shot mixture is utilized, the shot is often not useful in preventing hammer recoil.

Further discussion of the prior art and its associated shortcomings is provided in U.S. Pat. No. 1,045,145; U.S. Pat. No. 2,604,914; U.S. Pat. No. 2,928,444; U.S. Pat. No. 4,831,901; U.S. Pat. No. 5,118,117; U.S. Pat. No. 5,408,902; and German Patent No. 1,273,449.

It is an object of the present invention to overcome these, and other limitations of the prior art. Other objects of the present invention will be apparent to those of ordinary skill in the art having the benefit of this disclosure.

SUMMARY OF THE INVENTION

In accordance with one aspect of the invention a shock-absorbing hammer includes a handle, a tension rebar positioned within the handle, a compression rebar positioned within the handle, a striking head coupled to the compression rebar and a claw head coupled to the tension rebar. The striking head and the claw head are adapted to move relative to one another.

In another aspect of the invention, a shock-absorbing hammer includes a handle and a head coupled to the handle. The head has a top surface and a lower surface, with the lower surface of the head coupled to the handle. The head defines a striking head and a claw, and at least a portion of the head defines a recess extending down from the top of the head. The head further defines a slit extending from the top surface of the head towards the lower surface of the head, wherein the slit extends through at least part of the portion of the head that defines the recess.

In yet another aspect of the invention, a hammer includes a handle defining a first end which is opposite a second end. A striking assembly is coupled to the first end of the handle. The striking assembly includes a main striking head and a secondary striking head, and a claw feature is coupled to the second end of the handle.

In a still further aspect of the invention, a shock-absorbing hammer having a claw feature has a striking head having a first end for striking objects and a second end. An upper handle portion includes a first and a second end with the claw feature being integrally attached at the upper handle first end forming a lagging mass. The upper handle second end defines a pocket adapted to receive the striking head second end in a manner such that the striking head and the claw feature move with respect to each other when the striking head strikes an object. A lower handle portion is hingedly attached to the upper handle portion such that the upper and the lower handle portions move pivotally with respect to each other when the striking head strikes an object, but remain fixed together when the claw feature is used.

Another aspect of the invention presents a shock-absorbing hammer including a handle, a rigid head cover affixed to the handle and defining a cavity therein. First and second striking heads are situated within the head cover, with each striking head including a striking portion and defining a circumferential collar. The first striking head defines a cavity adapted to slidably receive a lug extending from the second striking head. The head cover has first and second ends, each end defining an opening through which the striking portions of the first and second striking heads, respectively, extend. The head cover first and second ends each define a hard stop, against which the circumferential collars of the first and second ends, respectively, seat for preventing the striking heads from falling out of the head cover. A biasing member is situated between the circumferential collars for forcing the first and striking heads apart such that a gap is formed between the striking heads.

A still further aspect of the invention includes a hammer for driving nails which has a handle and a striking head coupled to the handle. The striking head is adapted to strike and therefore drive a nail, wherein the construction of the striking head is such that vibrations are produced in the striking head when a nail is struck by the striking head. Further, means coupled to the handle and to the striking head absorbs at least a portion of the vibrations produced when a nail is struck by the striking head.

BRIEF DESCRIPTION OF THE DRAWINGS

Other objects and advantages of the invention will become apparent upon reading the following detailed description and upon reference to the drawings in which:

FIG. 4 illustrates a hammer constructed according to certain aspects of the present invention including first and second striking heads encapsulated in a load bearing cover.

FIG. 7 illustrates yet another hammer constructed according to certain teachings of the present invention in which a claw feature is connected to a handle opposite a head portion.

Figure 1:
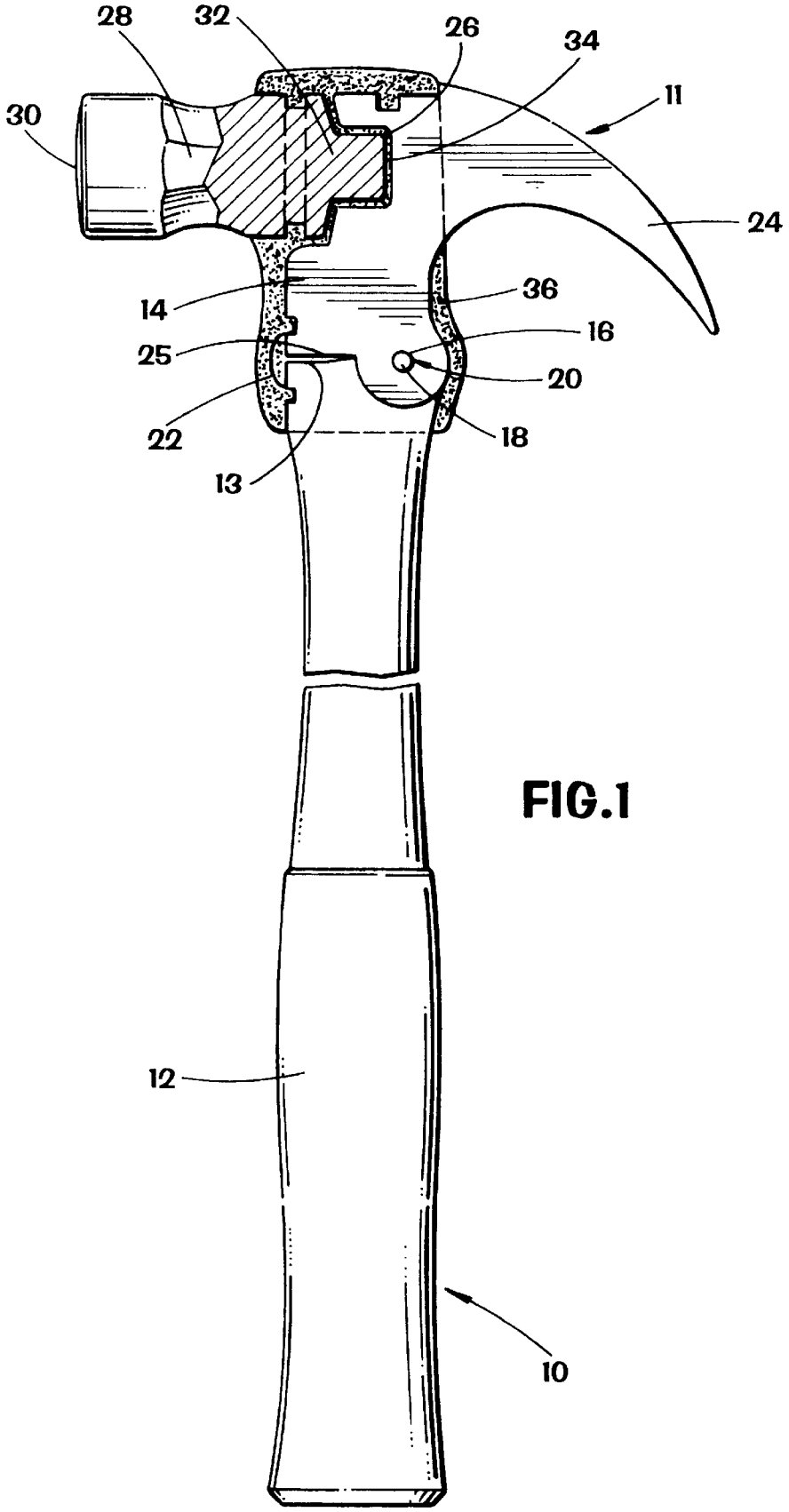
FIG. 1 illustrates a hammer constructed according to certain teachings of the present invention including upper and lower handle portions that are hingedly attached to one another and a claw portion integral with the upper handle portion.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the drawings and in particular, FIG. 1, a dead blow hammer having a claw feature in accordance with the present invention is shown. In general, the hammer 10 comprises a head portion 11, a lower handle portion 12 and an upper handle portion 14. The lower handle portion 12 may be fabricated out of wood or metal similarly to a standard carpenter's hammer, or vibration absorbing materials such as fiberglass or a rubber coated composite may be used. The upper handle portion 14 is hingedly attached to the lower portion 12, allowing the head portion to pivot relative to the handle 12. The hinge connection 20 may comprise a single lug extending from the lower portion 12 towards the upper handle portion 14. The upper handle portion 14 has two lugs extending therefrom in a spaced relationship whereby the lug of the lower handle portion 12 is received in between the two lugs of the upper handle portion 14. An aperture 16 extends through the lugs of the upper and lower handle portions and a pin 18 extends through the apertures whereby the upper handle portion 14 pivots about the pin 18 to hingedly attach the two handle portions. The junction of the lower handle portion 12 and the upper handle portion 14 opposite hinge 20 are held together by a spring clip 22 which may be fashioned out of typical spring steel.

The head portion 11 includes the upper handle portion 14 with a claw portion 24 integral therewith. The claw 24 defines a generally elongated v-shaped opening (not shown) for pulling nails and the like. Opposite the claw 24, the upper handle portion 14 defines a pocket 26 fashioned to receive a striking head 28. The striking head 28 has a first end 30 for striking nails and other surfaces and a second end 32 that is received into the pocket 26 in a spaced relationship such that a gap 34 is formed between the second end 32 and the pocket 26. In other words, the striking head 28 "floats" in the pocket 26 of the upper handle 14. In one embodiment, the gap 34 between the second end 32 of the floating striking head and the upper handle portion 14 is approximately 0.75 millimeters. In an alternate embodiment, end 32 of the striking head is slid inside pocket 26 in a piston fashion. This would prevent rotation of the head about an axis perpendicular to the paper in FIG. 1.

An elastomeric material, preferably polyurethane 36, encapsulates the upper handle portion 14, the second end 32 of the floating striking head 28, and the portion of the lower handle 12 adjacent the hinge 20. The striking head 28 also includes a circumferential groove which allows the polyurethane encapsulation 36 to capture the striking head 28 and hold it in place within the encapsulation 36. Further, the polyurethane encapsulation 36 works in conjunction with spring clip 22, forming a "composite spring," to keep the hinged upper and lower handle portions closed, except when the hammer is used to strike an object, where the handles pivot apart slightly.

The use of the embodiment of the dead blow hammer having a claw feature shown in FIG. 1 is illustrated as follows. For example, when the hammer is used to drive a nail, the floating striking head 28 hits the nail. The impact of the striking head 28 hitting the nail causes the polyurethane encapsulation 36 to deform, and the floating striking head 28 moves through the gap 34 between the striking head 28 and the upper handle portion 14, cushioning the blow and countering recoil. The upper handle 14 together with the claw portion 24 form a lagging mass, which contacts the second end 32 of the striking head 28 due to the momentum of the hammer 10 striking the nail, which also counters the tendencies of the hammer to recoil or rebound. The upper handle portion 14 pivots apart slightly from the lower handle portion 12, which provides vibration isolation of the handle.

When the hammer 10 is used for pulling a nail or for prying, the claw portion 24 is slipped under the object to be pried. The lower handle portion 12 is moved in a direction opposite the claw portion 24. The location of the hinge 20 does not allow the upper and lower handles to pivot when the handle is moved in this direction, thereby creating a rigid lever for prying. This effect is accomplished because of the hinge location and because the faces 13 and 25 are in contact during nail pulling.

Figure 2:
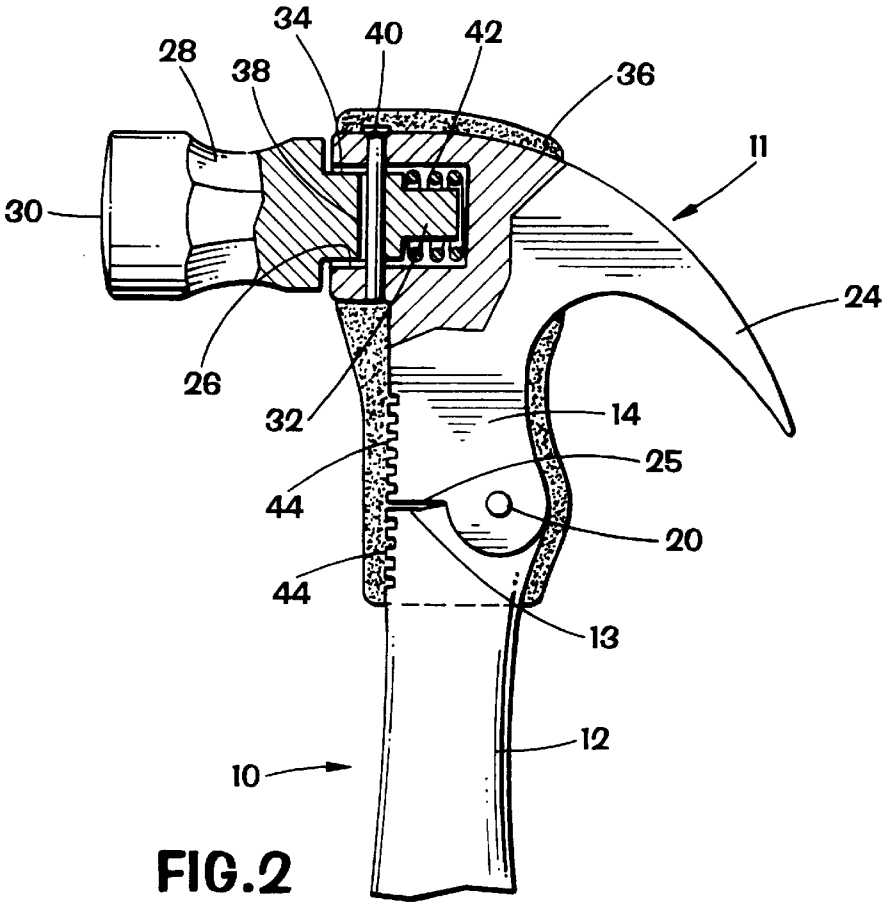
FIG. 2 illustrates an alternate embodiment of the hammer illustrated in FIG. 1.

An alternate embodiment of a dead blow hammer in accordance with the present invention is pictured in FIG. 2. Similarly to the embodiment of FIG. 1, the embodiment of FIG. 2 has an upper handle portion 14 integral when the claw portion 24. A hinge 20 connects the upper handle portion 14 with the lower handle portion 12. The striking head 28 has a first end 30 for striking objects and a second end 32 which slidably fits into a pocket 26 formed in the upper handle portion 14. The second end 32 defines a bore 38 therethrough which is perpendicular to the axis of the head 28. A pin 40 couples the upper handle portion 14 to the striking head 28 by extending through the bore 38. The bore 38 through the striking head 28 has a diameter slightly larger than the pin 40 allowing the striking head 28 to axially move, or float, in the pocket 26 relative to the upper handle portion 14 and claw 24 combination. A biasing member such as a compression spring 42 is located within the pocket 26 of the upper head portion 14, biasing the striking head 28 away from the inner surface of the pocket 26, thereby maintaining a gap of approximately 0.75 millimeters between the striking head 28 and the upper handle portion 14.

An elastomeric material such as polyurethane encapsulates the upper handle portion 14 and the lower handle 12 just below the hinge 20. The elastomeric material 36 acts as a spring and functions to hold the hinged upper handle portion 14 and lower handle portion 12 together, but allowing them to pivot slightly apart when the hammer strikes a nail or other object. Both the upper and lower handle portions have a series of teeth 44 for grabbing the elastomeric material 36 to better hold both handle portions in place.

When the hammer of FIG. 2 strikes an object, the striking head 28 moves against the compression spring 42 towards the upper handle 14 because the bore 38 diameter is slightly larger than the diameter of pin 40 extending therethrough. This has the effect of cushioning the blow. The elastomeric encapsulation 36 deforms slightly, which allows the upper handle portion 14 to pivot slightly away from the lower handle portion 12, which further absorbs vibration. The momentum of the strike causes the lagging mass formed by the upper handle portion 14 and claw 24 to contact the striking head 28 and counter the recoil or rebound. As with the embodiment illustrated in FIG. 1, the location of the hinge 20 does not allow the upper and lower handles to pivot when the claw 24 is used for pulling. This effect is accomplished because of the hinge location and because the faces 13 and 25 are in contact during nail pulling.

Further embodiments of the shock absorbing hammer may include the floating head 28 and lagging mass/claw 24 as in the embodiments of FIGS. 1 and 2, wherein the head 11 does not pivot with respect to the handle 12.

Figure 3:
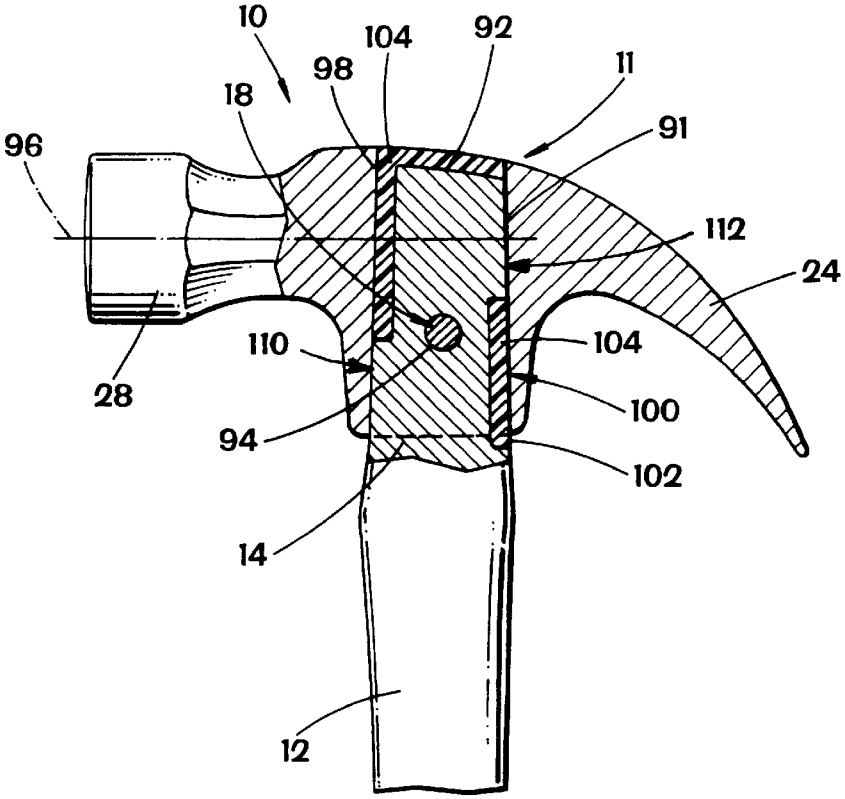
FIG. 3 illustrates an alternate embodiment of the hammers illustrated in FIGS. 1 and 2.

An alternate embodiment of the shock absorbing hammer illustrated in FIG. 1 and FIG. 2 is shown in FIG. 3. The hammer of FIG. 3 incorporates only the pivot feature of the embodiments of FIGS. 1 and 2 to absorb a portion of the shock of a nail strike. The shock-absorbing hammer 10 of FIG. 3 includes a head 11 having an integral striking portion 28 and claw 24. The striking head 28 and integral claw 24 may be of a forged construction. The head 11 defines an opening 91 which may be generally rectangular shaped extending therethrough. A handle 12 includes an upper portion 14 which defines a top surface 92 and extends into the opening 91. The opening 91 has an axis that extends generally transverse to the axis defined by the head portion 11, such that the handle extends generally perpendicular to the axis of the head portion 11. The handle 12 may be fashioned out of fiberglass, graphite, wood, metal, or other suitable material.

A pin 18 extends through openings 94 in the head 11 and handle upper portion 14 to hingedly attach the upper portion 14 to the head 11. The pin 18 is located below the horizontal centerline 96 of the striking portion 28. In a preferred embodiment, the pin 18 is about 0.8 centimeters in diameter and the openings are positioned about 1 to 2.5 centimeters below the centerline 96. The handle upper portion 14 defines first and second notches 98, 100 on opposite sides of the upper portion 14. The first notch 98 extends from the upper surface 92 downward (as shown in FIG. 3), terminating approximately even with the opening 94. The second notch 100 originates approximately even with the opening 94 and extends downward past the point where the head 11 meets the handle 12, denoted by reference numeral 102.

The upper surface 92 and the first and second notches 98, 100 are filled with an elastomer 104. The arrangement of the notches 98, 100 is such that the elastomer 104 allows only clockwise rotation of the head 11 relative to the handle 12 (as illustrated in FIG. 3). This allows the head 11 to pivot slightly with respect to the handle 12 to is dampen the vibration of striking. The hammer 10 as illustrated in FIG. 3 allows only a vary slight rotation—less than a degree in one embodiment of the invention. This is enough to dampen the vibration while at the same time, not significantly affecting the angle of incidence of a nail strike. In other words, the rotation allowed is less than the range of angles that a typical hammer user would experience when striking several times—the user does not hit the nail exactly flush with every hit. The notch 98, 100 and elastomer 104 arrangement do not allow rotational flexing during nail pulling because their design allows direct contact between the head 11 and handle 14 at contact points 110, 112. This allows for rigid, durable stiffness, which is necessary for the high loads experienced during nail pulling.

FIG. 4 illustrates yet another embodiment of the present invention. This embodiment includes a handle portion 12 fashioned out of a rigid, non-elastomeric material such as metal or nylon, for example. Additional materials such as reinforced polypropylene may also be used. The handle 12 may include a rigid inner skeleton. This embodiment further includes first and second striking heads 46 and 48 which are aligned with each other. The striking heads 46 and 48 are encapsulated in a load bearing, rigid (non-elastomeric) head cover 50 which is attached to the handle 12. Alternately, the head cover 50 may be integral with the handle 12. The head cover 50 has first and second openings 52 and 54 through which the first and second striking heads 46 and 48 extend. Each striking head 46 and 48 further includes a circumferential collar 56 and 58 which seats against hard stops formed by the inside surface of the head cover 50, preventing the striking heads 46 and 48 from falling out the head cover 50.

The first striking head 46 includes a generally square-shaped cavity 60 which slidably receives a lug 62 extending from the second striking head 48. This allows the two striking heads 46 and 48 to move laterally (or axially) with respect to each other, but the shape of the cavity 60 and lug 62 prevent the two striking heads 46 and 48 from twisting relative to each other inside the head cover 50. A biasing member, such as a spring 64 is positioned between the two striking heads 46 and 48 forces the heads apart, creating a small air gap 66 between the two heads 46 and 48. For example, when one of the striking heads strikes an object, the remaining striking head acts as a lagging mass. The momentum of the strike causes the lagging mass to move in the direction of the strike against the spring 64 and impact the striking head.

Figure 5:
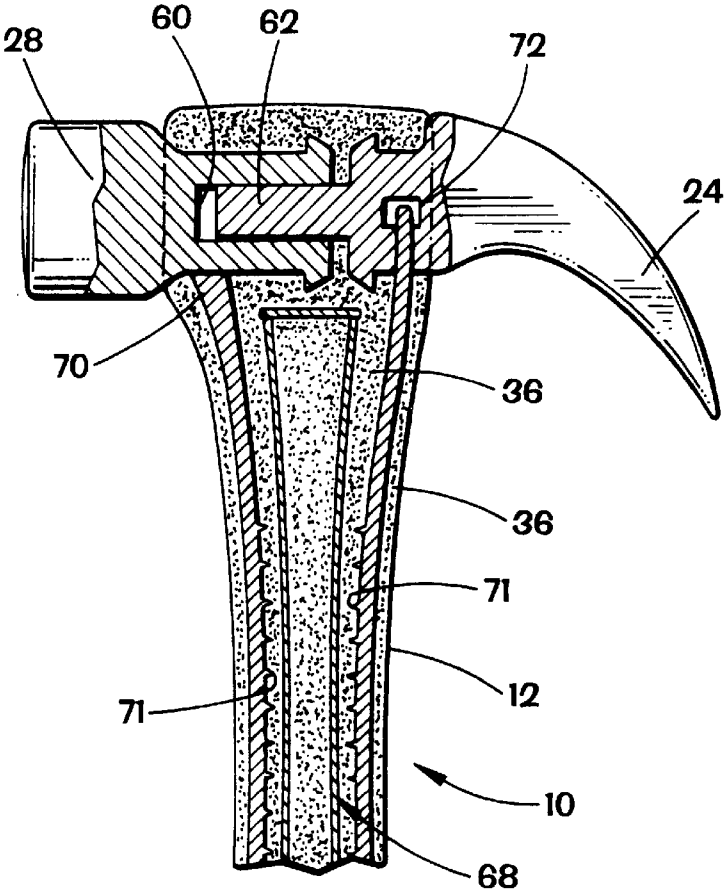
FIG. 5 illustrates yet another hammer constructed according to certain teachings of the present invention including a striking head and a claw and tension and compression rebars attached to the head and claw.

Turning now to FIG. 5, an alternate embodiment of the present invention is shown having a handle 12, a striking head 28 and a claw 24. The striking head 28 has a generally square shaped cavity 60 adapted to slidably receive a lug 62 extending from claw 24. The shape of the cavity 60 and associated lug 62 prevent the striking head 28 from rotating relative to the claw 24. The claw 24 functions as a lagging mass and moves towards the striking head 28 upon the strike. The handle 12 includes a cradle or skeleton 68, which may be preform nylon. A compression rebar 70 and a tension rebar 72 are also positioned within the handle. The compression rebar 70 is attached to the striking head 28 and the tension rebar 72 is attached to the claw 24. An elastomeric material 36 such as polyurethane encapsulates the handle 12 and a portion of the striking head 28 and claw 24. The rebars 70 and 72 function to add bending stiffness between the handle and the head, but not shear stiffness. In other words, when the hammer is used to strike an object such as a nail the rebars allow the striking head 28 and the claw 24 to slide laterally relative to each other; however, when the claw 24 is used to pry or to pull a nail, the rebars add bending stiffness to aide in the prying or pulling. Teeth 71 on the rebars are encapsulated and retained by the elastomeric encapsulation 36.

Figure 6C:
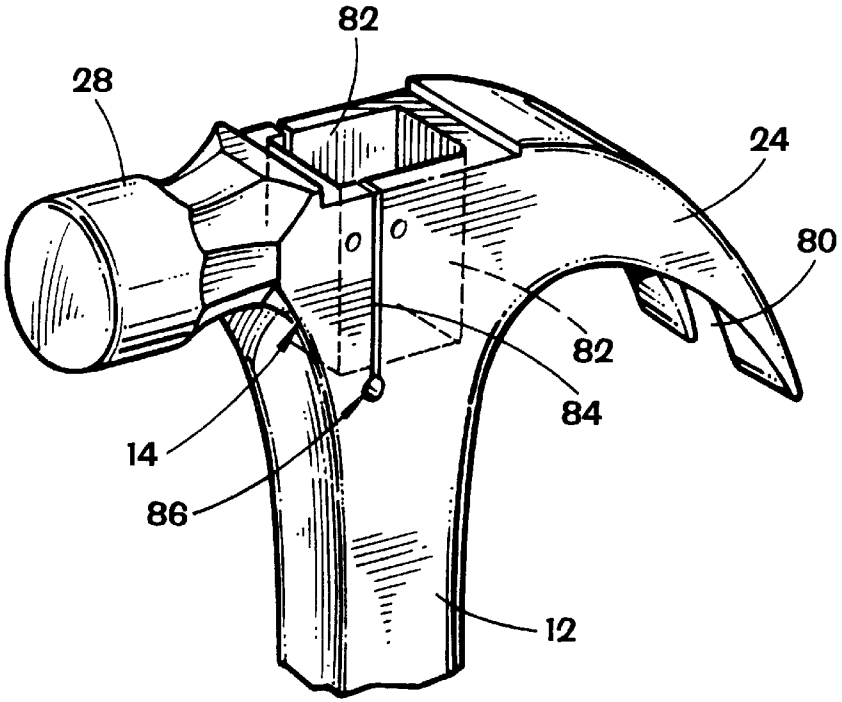
FIGS. 6A, 6B and 6C illustrate still another hammer constructed according to certain aspects of the present invention that includes a head portion defining a recess and a slit that extends through the head portion.
Figure 6A:
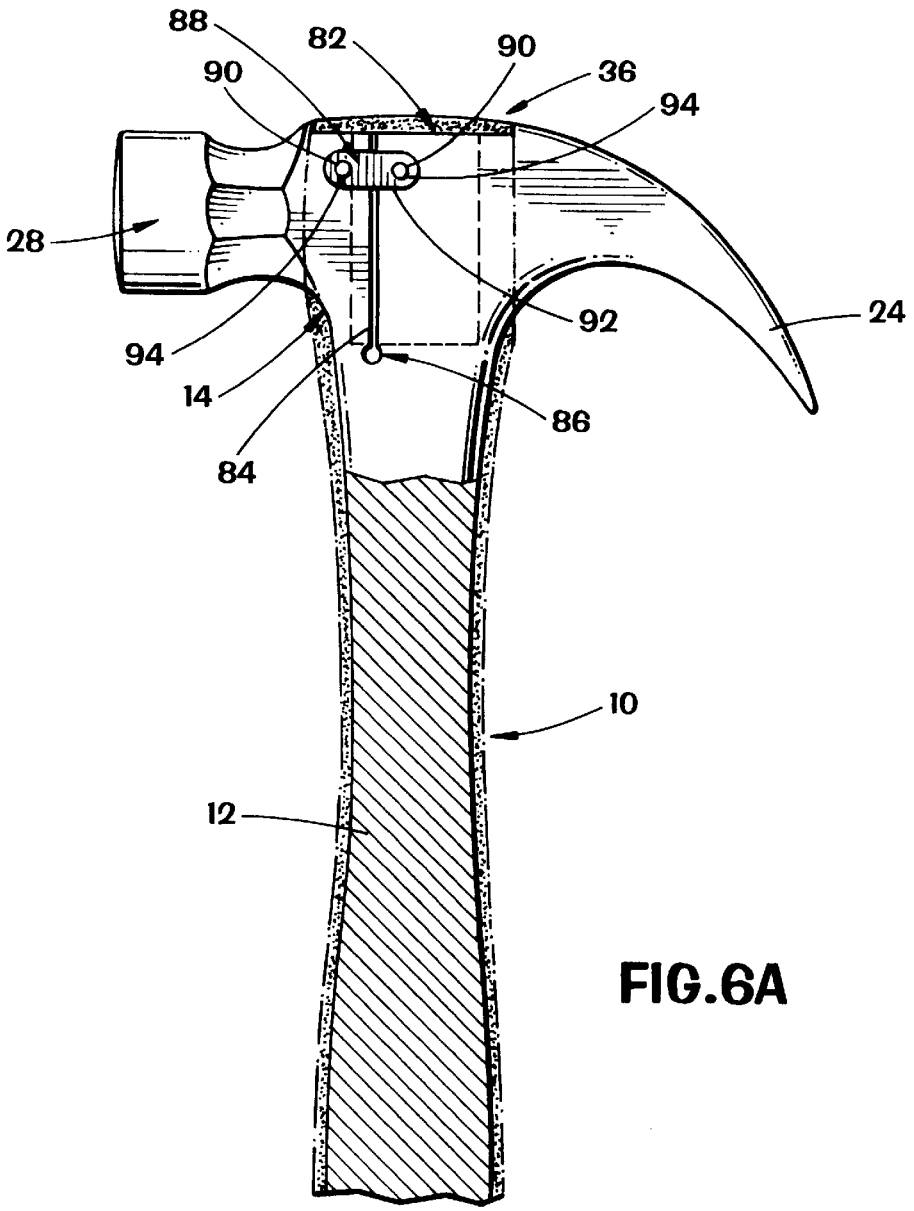
Figure 6B:
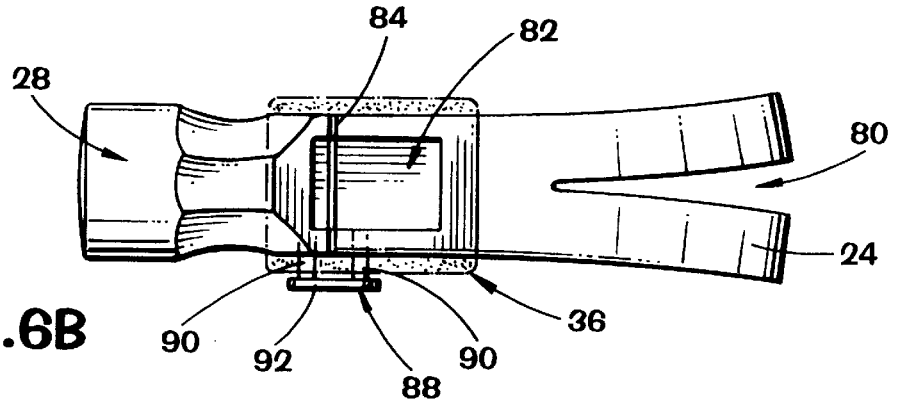

In FIGS. 6A, 6B and 6C, another exemplary embodiment of the present invention is shown, providing a no-shock, fatigue reducing hammer. FIG. 6A is a front elevation view and FIG. 6B shows a top plan view of this particular embodiment. A perspective view is shown in FIG. 6C. The hammer of FIGS. 6A, 6B and 6C includes lower handle 12 and upper handle 14 portions. Upper handle portion 14 and lower handle portion handle 12 may be integrally attached, as shown in FIGS. 6A, 6B and 6C. A striking head 28 and a claw 24 are integral with the upper handle portion 14. The claw also includes generally elongated v-shaped opening 80 for pulling items such as nails. This embodiment may comprise an integral steel striking head 28, claw 24 and handle 12/14, or the handle may be fashioned out of a lightweight, vibration absorbing composite material with the striking head 28 and the claw 24 made of metal.

The upper head portion 14 may define a recess 82 therein, extending down from the top of the upper head 14. In the particular embodiment illustrated, recess is included which is generally rectangular shaped, having dimensions of approximately 2.5×1.5 centimeters, which is best shown in the top plan view of FIG. 6A and the perspective view of FIG. 6B. The recess 82 is about 4 centimeters deep, shown in phantom lines in FIGS. 6A and 6C. Preferably, a wall thickness of about 0.3 centimeters is maintained between the recess and the outer surface of the hammer 10.

The upper handle portion 14 further defines a slit 84 extending generally transverse to the axis of the striking head 28/claw 24 combination, and generally parallel to the axis of the handle 12. Slit 84 extends through the entire width of the upper head portion 14, originating at the top of the upper handle portion 14 and terminating at a stress relief hole 86 which extends through the width of handle 12. Slit 84 is preferably between about 0.4 millimeters and about 0.7 millimeters wide, and about 4 centimeters long. Stress relief hole 86 preferably has a diameter of about 2 millimeters. The slit 84 is biased towards the striking head 24 to provide structural support between the handle and the claw for nail pulling purposes. Biasing the slit 84 in this manner also helps balance the mass between the striking head portion 28 and the claw 24.

A hard stop feature 88 prevents the slit 84 from opening significantly beyond the desired gap. This prevents the head 14 from breaking at the stress relief hole 86. In FIGS. 6A, 6B and 6C, the hard stop 88 comprises two pins 90 attached to the upper head portion 14 on either side of slit 84, with a link 92 having two holes 94 fit over the pins 90. Each of the holes 94 in the link 92 has a diameter that is larger than its corresponding pin 90, and the link is biased such that the slit 84 is allowed to close upon a hammer strike, but prevented from opening significantly beyond the desired gap. An alternate embodiment of the hard stop 88 is envisioned in which a staple-like member is disposed in holes on either side of the slit 84, each hole having a diameter larger than that of the staple member, again restraining the slit 84 from opening significantly, but not from closing.

Additionally, an elastomeric cover 36, preferably polyurethane, may cover the upper handle portion 14, leaving the striking head 28 and the claw 24 exposed. Alternately, the upper handle 14 and lower handle 12 may both be encapsulated with the elastomeric cover 36. The elastomeric cover 36 functions to cover the slit 84, preventing debris from clogging the slit 84. In the embodiment illustrated in FIG. 6A–6C, the elastomeric cover 36 does not fill the slit 84, so the slit 84 is still able to close. Preventing the elastomeric cover 36 from filling the slit 84 may be accomplished by covering the slit 84 with a mask such as tape prior to encapsulating the handle. The elastomeric covering 36 may be applied by dipping the portion of the hammer 10 to be covered into the elastomeric covering material while the elastomeric material is in a liquid state, then allowing the elastomeric covering material to set on the hammer. Further, the elastomeric cover 36 provides a "soft fulcrum" area which would not damage a work piece when the claw 24 is used for pulling nails. Moreover, if the cover 36 extends to cover the lower handle portion 12, it provides a hand cushion for the user, which further reduces shock.

When the hammer 10 of FIG. 6 is used to drive a nail or other object, the striking head 28 hits the object. The claw 24 functions as a lagging mass, and the slit 84 allows the claw 24 to move in the direction of the striking head 28 until contact is made between the claw 24 and the striking head 28, thereby deadening the blow and reducing recoil and vibration. The recess 82 functions to reduce the net area of contact between the striking head 28 and the claw 24 during the hammer strike, further deadening the blow and reducing the tendency of the hammer to recoil.

FIG. 7 illustrates an embodiment of the present invention which adds a claw feature 74 to the handle 12 opposite the striking head portion 76. As illustrated in FIG. 7, this embodiment includes two striking heads, including a main striking head 28 comprising a common 16 ounce head for driving nails and a secondary head 29 which could include another nail driving head identical to the main striking head, a rubber mallet, a smaller nail striking head, or a rounded face nail driver for drywall.

Alternately, the striking head 76 may comprise any of the various embodiments of striking heads disclosed thus far, or it may be of the form of the striking head assembly disclosed in U.S. Pat. No. 5,408,902, the entire disclosure of which is hereby incorporated by reference. The claw feature 74 connected to the handle 12 opposite the head portion 76 is similar to the claw on a standard carpenter's hammer, though it may be fashioned out of a lightweight material such as fiber-epoxy composite. Further, this claw feature 74 and handle 12 combination form a comfortable ergonomic hand pocket 78 for the user. It also functions as a safety feature, preventing the hammer from slipping out of the hands of the user and providing protection of the users hands. When the claw feature 74 is used for prying or pulling, the head portion 76 functions as a convenient handle grip to aid the user.

Alternate embodiments of the hammer of FIG. 7 are envisioned in which the claw feature 74 extends from the handle 12 in a direction different from that illustrated. For example, the claw feature 74 may extend in a direction generally perpendicular to an imaginary line passing through the striking surfaces of the two striking heads. An embodiment is also envisioned wherein the claw feature 74 is rotatably attached to the handle portion, whereby the claw can be rotated into a position that is either comfortable or convenient for the hammer user.

While the invention has been described in connection with the illustrative embodiments discussed above, those skilled in the art will recognized that many variations may be made without departing from the present invention. Accordingly, the above description of several embodiments is made by way of example and not for purposes of limitation. The present invention is intended to be limited only by the following claims.

What is claimed is:

1. A shock-absorbing hammer comprising:

a handle;

a tension rebar positioned within the handle;

a compression rebar positioned within the handle;

a striking head coupled to the compression rebar;

a claw head coupled to the tension rebar, wherein the striking head and the claw head are adapted to move relative to one another;

a lug extending from a first end of the claw head;

the striking head defining a cavity adapted to slidably receive the lug; and wherein the lug and the cavity are generally square-shaped to prevent the striking head and the claw head from twisting relative to each other.

2. A shock-absorbing hammer comprising:

a handle; and a head coupled to the handle, the head having a top surface and a lower surface, the lower surface of the head being coupled to the handle, the head defining a striking head and a claw, the claw including a first slit for pulling nails, the head further defining a second slit extending from the top surface of the head towards the lower surface of the head situated generally between the striking head and the claw to allow the claw to move toward the striking head upon a hammer strike.

3. The shock-absorbing hammer of claim 2 wherein at least a portion of the head defines a recess extending down from the top of the head, wherein the slit extends through at least part of the portion of the head that defines the recess.

4. The shock-absorbing hammer of claim 3 wherein the recess is generally rectangular-shaped.

5. The shock-absorbing hammer of claim 2 further comprising a stress relief hole extending through the head, the slit extending from the top surface of the head to the stress relief hole.

6. The shock-absorbing hammer of claim 2 further comprising a hard stop for preventing the slit from opening more than a desired distance.

7. The shock-absorbing hammer of claim 6 wherein the hard stop comprises:

first and second pins fixed on opposite sides of the slit;

a link defining first and second openings adapted to fit over the first and second pins, the openings having diameters larger than the diameters of the pins; and the link being placed over the pins such that the slit is allowed to close upon a hammer strike, but not open more than a predetermined distance.

8. The shock-absorbing hammer of claim 6 wherein the hard stop comprises:

a generally U-shaped member defining a pair of legs;

the head defining first and second holes situated on opposite sides of the slit, each hole being adapted to receive one of the legs and having a diameter larger than the diameter of the leg; and the legs being placed within the holes such that the slit is allowed to close upon a hammer strike, but not open more than a predetermined distance.

9. The shock-absorbing hammer of claim 2 wherein the handle, the striking head and the claw are integrally formed.

10. A hammer comprising:

a handle, the handle defining a first end and a second end, the first end being opposite the second end;

a striking assembly coupled to the first end of the handle, the striking assembly including a main striking head and a secondary striking head; and a claw feature rotatable attached to the second end of the handle.

11. A shock-absorbing hammer having a claw feature, the hammer comprising:

a striking head having a first end for striking objects and a second end;

an upper handle portion having a first and a second end; a claw feature being integrally attached at the upper handle first end forming a lagging mass, the upper handle second end defining a pocket adapted to receive the striking head second end in a manner such that the striking head and the claw feature move with respect to each other when the striking head strikes an object;

an elastomeric material separating the striking head second end from the upper handle second end; and a lower handle portion attached to the upper handle portion.

12. The shock-absorbing hammer of claim 11 wherein the lower handle portion is hingedly attached to the upper handle portion such that the upper and the lower handle portions move pivotally with respect to each other when the striking head strikes an object, but remain fixed together when the claw feature is used.

13. The shock-absorbing hammer of claim 12 further comprising a retaining member for biasing the upper and lower handle portions together when the claw feature is used while allowing the upper and lower handle portions to move pivotally with respect to each other when the striking head strikes an object.

14. The shock-absorbing hammer of claim 12 further comprising an elastomeric encapsulation covering the striking head second end, the upper handle second end, and at least part of the lower handle portion.

15. The shock-absorbing hammer of claim 11 further comprising:

the striking head second end defining a bore therethrough;

a pin having two ends extending through the bore, each end being fixed within the upper handle second end; and the bore having a diameter larger than the diameter of the pin, such that the striking head is movable laterally relative to the upper handle.

16. The shock-absorbing hammer of claim 11 further comprising a compressible biasing member situated between the striking head portion and the upper handle portion for biasing the striking head away from the upper handle portion.

17. A shock-absorbing hammer comprising:

a head portion having a striking head for driving nails and a claw for pulling nails, the head portion defining an opening having an axis transverse to an axis defined by the head portion;

a handle defining a top surface extending into the opening, the handle pivotally attached to the head portion;

the head portion and the handle arranged such that the handle pivots relative to the head portion upon striking a nail.

18. The shock absorbing hammer of claim 17 wherein the head portion and the handle are further arranged such that the handle does not pivot with respect to the head portion upon pulling a nail.

19. The shock absorbing hammer of claim 17 wherein the handle further defines a first lateral surface adjacent the striking head and defining a first notch therein, the first notch extending from the top surface to a pivot point about which the handle pivots with respect to the head portion.

20. The shock absorbing hammer of claim 19 wherein the head further includes a bottom portion and the handle further defines a second lateral surface adjacent the claw, the second lateral surface defining a second notch therein extending from the pivot point past a point where the bottom portion meets the handle.

21. The shock absorbing hammer of claim 20 wherein the first and second notch are filled with an elastomer.

22. The shock-absorbing hammer of claim 17 wherein the first striking head cavity and the second striking head lug are generally square-shaped to prevent the striking heads from twisting relative to each other.

23. A shock-absorbing hammer comprising:

a handle;

a rigid, load bearing head cover affixed to the handle, the head cover defining a cavity therein;

first and second striking heads situated within the head cover, each striking head including a striking portion and defining a circumferential collar; the first striking head defining a cavity adapted to slidably receive a lug extending from the second striking head;

the head cover having first and second ends, each end defining an opening through which the striking portions of the first and second striking heads, respectively, extend;

the head cover first and second ends each defining a hard stop, against which the circumferential collars of the first and second ends, respectively, seat for preventing the striking heads from falling out of the head cover; and a biasing member situated between the circumferential collars for forcing the first and striking heads apart such that a gap is formed between the striking heads.

24. A hammer for driving nails, the hammer comprising:

a handle;

a striking head coupled to the handle, the striking head adapted to strike and therefore drive a nail, wherein the construction of the striking head is such that vibrations are produced in the striking head when a nail is struck by the striking head; and means coupled to the handle and to the striking head for allowing the striking head to pivot relative to the handle, thereby absorbing at least a portion of the vibrations produced when a nail is struck by the striking head.

* * * * *